United States Patent [19]

Cruden, Jr.

[11] 3,934,776

[45] Jan. 27, 1976

[54] APPARATUS FOR FORMING PIPED OPENINGS IN A GARMENT

[76] Inventor: John L. Cruden, Jr., Marvin Hollow Road, Walton, N.Y. 13856

[22] Filed: Oct. 1, 1971

[21] Appl. No.: 185,562

Related U.S. Application Data

[62] Division of Ser. No. 47,950, June 22, 1970, Pat. No. 3,654,635, which is a division of Ser. No. 739,812, June 25, 1968, Pat. No. 3,587,501.

[52] U.S. Cl. ..... 227/76; 227/21; 83/176; 83/451; 83/560; 83/902; 112/65; 270/61; 270/69

[51] Int. Cl. ..... D05b 3/00; A41d 27/20

[58] Field of Search ..... 83/902, 374, 451, 560, 83/563, 564, 176; 227/76, 64, 20, 21; 270/61, 69, 80; 112/68, 264, 65

[56] References Cited

UNITED STATES PATENTS

| | | | |
|---|---|---|---|
| 2,115,571 | 4/1938 | Cooper | 83/563 |
| 2,529,072 | 11/1950 | Bradford et al. | 112/68 |
| 2,889,790 | 6/1959 | Smith et al. | 112/65 |

*Primary Examiner*—J. M. Meister

[57] ABSTRACT

This disclosure is directed to a piped opening for use in a garment and an apparatus for making the opening. The piped opening comprises corresponding die-cut slits or cuts formed in the front and facing portion of a garment with the flap or flaps defined thereby being reversely folded inwardly of the respective front and facing portions to define a corresponding opening therein. An edging patch having a complementary slit or cut and reversely folded patch flaps is secured to one of the portions with the patch flaps positioned contiguous to corresponding flaps of the adjacent portion to form a partially piped opening. The front and facing portions are then reversely folded to dispose the edging patch therebetween with the respective openings defined in each, disposed in coaxial alignment. The front and facing portions are then secured.

The apparatus for locating and forming an opening in a garment, e.g. the facing portion of a piece of material, which is adapted to correspond to a complementary partially formed piped opening in the front portion, comprises a means for supporting the front and facing portions of a piece of material in the expanded position thereof. The support is defined by a pair of hinged sections which are adapted to enfold between an open coplanar position and a folded overlying position. Means are provided for securing the piece of material in expanded position on the support. A locating means is operatively associated with one section of the support and a forming means is operatively associated with the other portion of the support member. Actuating means operatively couple the locating means with a forming means whereby the positioning of the locating means with respect to the partially formed piped opening formed, e.g. in the front portion of the garment effects the proper positioning of the forming means over the facing portion of the garment. With the forming means in position, the operating or forming head thereof is actuated to sequentially die cut or otherwise form the slit and reversely fold the flaps thus formed relative to the plane of the facing portion. With the opening located and formed on the piece of material, the sections of the support are folded to reversely fold the facing portion relative to the front for disposing the formed openings therein into alignment. A means is provided to secure the front and facing in overlying relationship.

23 Claims, 47 Drawing Figures

INVENTOR.
JOHN L. CRUDEN JR.
BY Arthur F. Fattibene
ATTORNEY

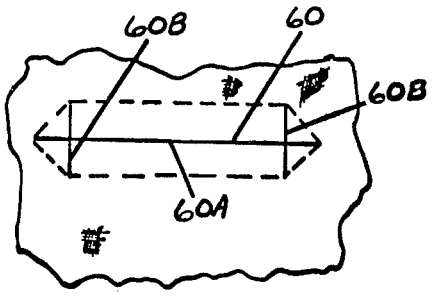
FIG. 29
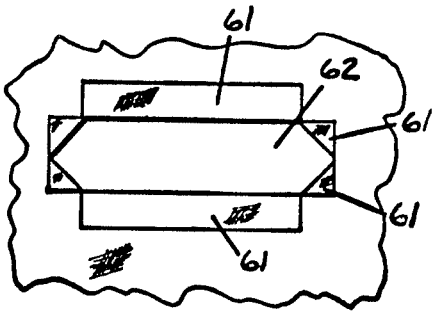
FIG. 30
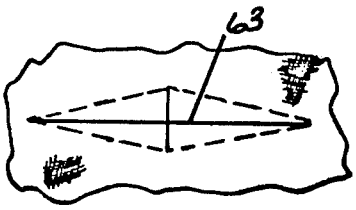
FIG. 31
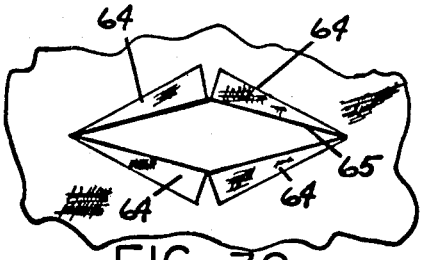
FIG. 32
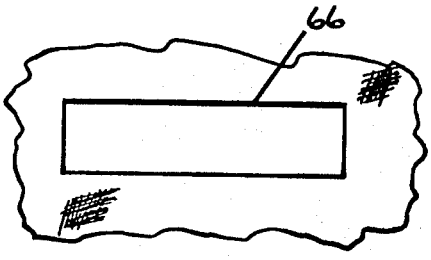
FIG. 33
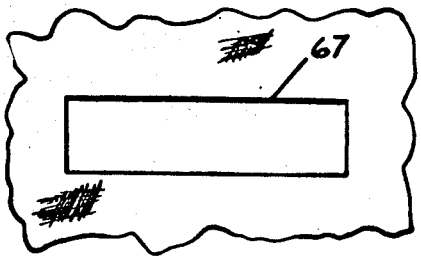
FIG. 34
FIG. 35
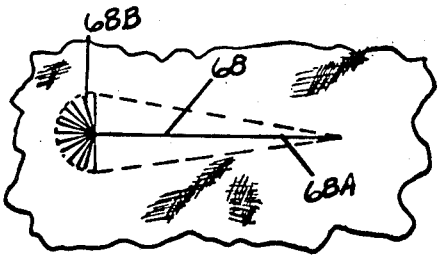
FIG. 36
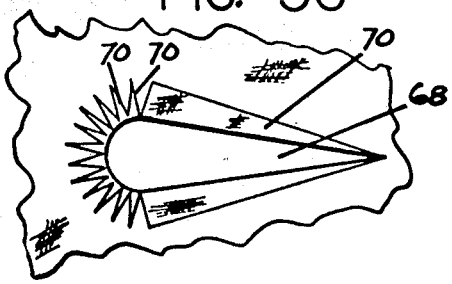

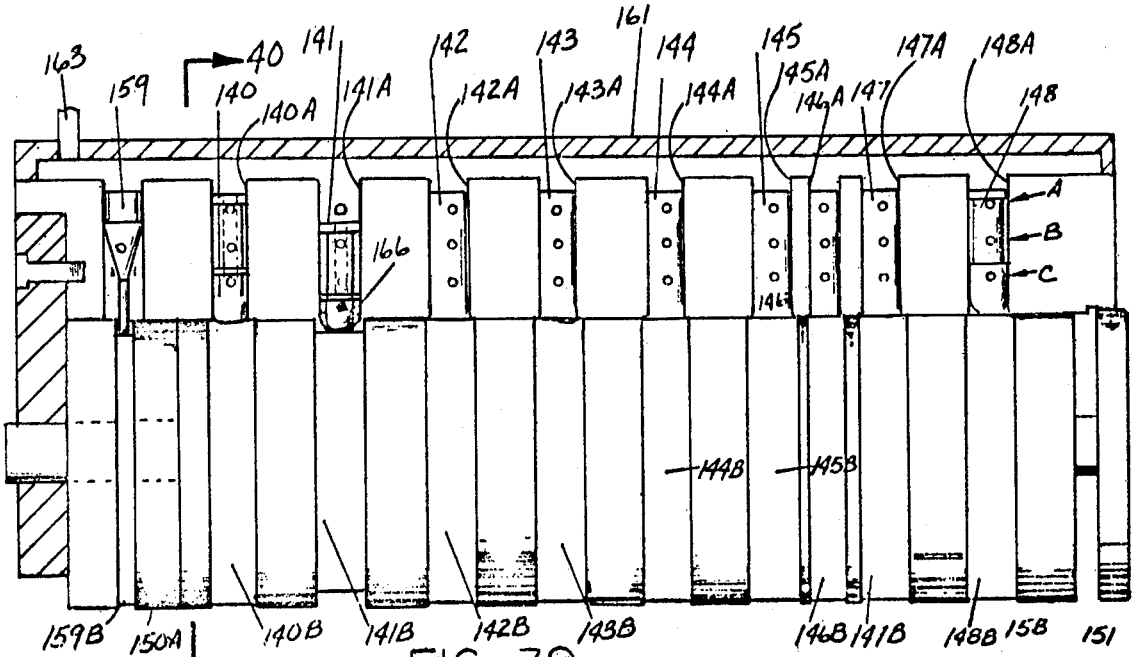
FIG. 39
FIG. 42 FIG. 43
FIG. 41
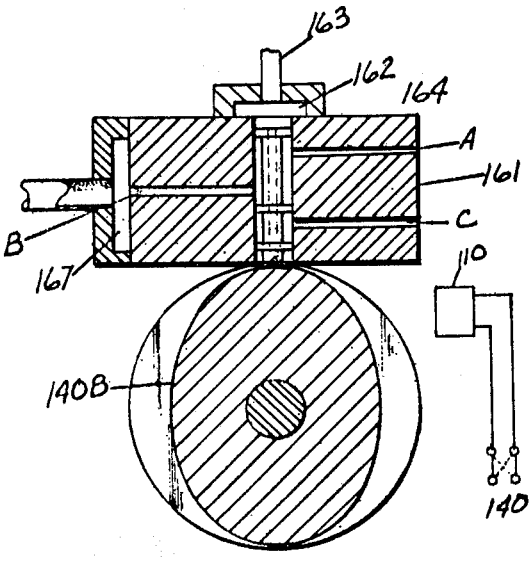
FIG. 40
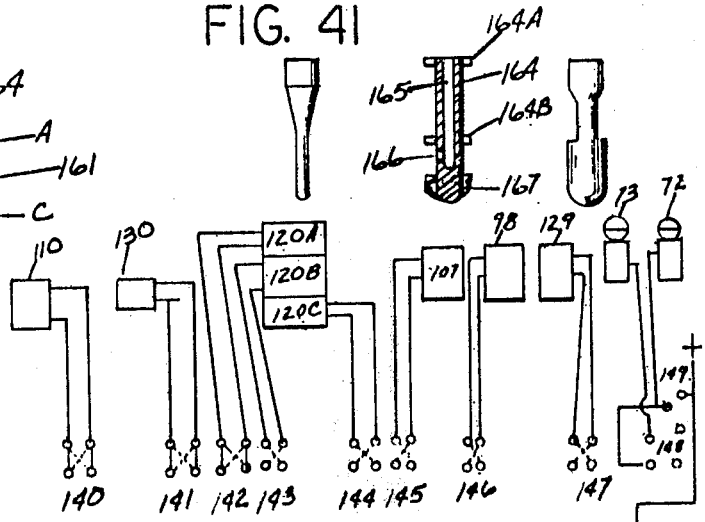
FIG. 38
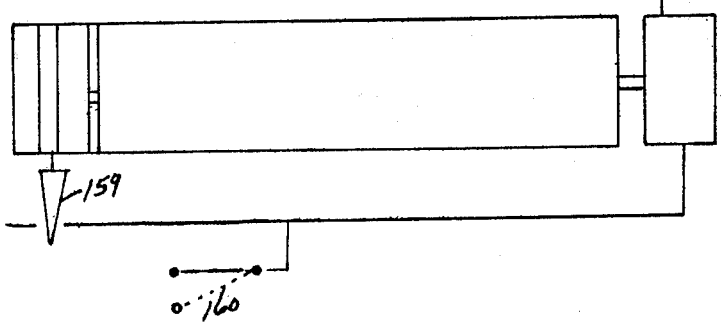

APPARATUS FOR FORMING PIPED OPENINGS IN A GARMENT

RELATED APPLICATIONS

This application is a divisional application of a co-pending application Ser. No. 47,950 filed June 22, 1970 for "Piped Open For Use In A Garment and Apparatus For Forming Same", now U.S. Pat. NO. 3,654,635 granted Apr. 11, 1972; said latter patent application being a divisional application of a co-pending patent application Ser. No. 739,812 filed June 25, 1968 for "Piped Opening for Use in a Garment and Method and Apparatus for Forming Same", now U.S. Pat. NO. 3,587,501 granted June 28, 1971.

THE PROBLEM IN THE ART

The manufacture of various garments as for example, suit jackets, coats, pants, trousers and the like, are frequently formed with the buttonholes and/or pockets which are usually referred to in the trade as piped openings. Heretofore the making of such piped openings required several manual operations which greatly increased the amount of time, labor and cost in forming such piped openings in the various garments. Generally these piped openings or buttonholes were first partially formed by high speed automatic machines of the type disclosed in U.S. Pat. No. 1,945,104. The openings formed by such machines were only partially completed in that the underside thereof presented a raw and unfinished appearance which was required to be traditionally hidden by another piece of material. Such other piece of material is generally referred to in the art as a facing. However, the difficulty heretofore encountered resided in the tedious and time consuming manner in which the complementary opening in the facing and the securing of the facing to the partially preformed opening formed in the front portion of the garment was performed.

Prior to this invention the opening in the facing to complement the mechanically formed opening in the front of the garment was manually performed. Generally an operator was required to fold the facing portion of the garment into overlying relationship with the front portion of the garment in which the partially formed opening was made, and by sense of feel locate the position of the complementary opening which was required to be formed in the facing. Thereafter the facing was manually cut with a suitable cutting tool at the proper point to define a complementary slit for determining the appropriately shaped opening. The flaps thus defined by the slit were reversely folded manually, and the facing with the complementary opening so formed reversely folded to cover the raw edges of the preformed opening formed in the front portion of the garment. The front and facing were then secured to complete the forming of the finished piped opening in the garment. This latter step of manually locating the complementary opening in the facing, folding and securing of the facing onto the front of the raw machine formed opening resulted in a tedious, time-consuming, laborious, and expensive procedure.

OBJECTS

It is an object of this invention to provide an improved piped opening construction which can be readily performed in a relatively simple and expedient manner which will greatly minimize the time, effort and cost of forming such piped openings.

Another object of this invention is to provide an improved apparatus by which the method of forming the piped opening may be accomplished with much ease and facility.

Another object of this invention is to provide an apparatus for automatically locating and forming of a complementary opening which was heretofore manually performed in the making of piped openings.

Another object of this invention is to provide an apparatus for accurately locating and forming of the complementary opening in preparation of the making of a piped opening in a garment, and securing the portion of the material in which such opening is formed in overlying relationship to the raw opening formed in the complementary portion of the garment.

Another object of this invention is to provide an apparatus having a forming head for successively cutting, folding and forming an opening of predetermined shape in the portion of a garment adapted to complement the raw opening formed in a complementary portion of the garment in a relatively simple and expedient manner.

Another object of this invention is to provide an apparatus for forming piped openings in a garment automatically with a minimum of effort and a maximum of proficiency.

Another object of this invention is to provide an improved piped opening construction which is relatively simple and which can be readily fabricated automatically.

Another object of this invention is to provide a piped opening construction requiring a minimum of operation to form the same.

BRIEF SUMMARY OF INVENTION

The foregoing objects and other features and advantages are attained by a piped opening in which a die-cut or a cut-slit is formed in complementary portions of a garment and the marginal portions or flaps defined thereby reversely folded out of the plane of their respective portions. An edging patch provided with a similar die-cut or slip and opening defined thereby is secured to the formed opening in one of the complementary portions so that the respective openings therein are in alignment. The complementary portions of the garment are then folded and secured with the edging patch disposed therebetween.

The foregoing piped openings are formed by locating the positioning of the opening to be formed in one of the complementary portions of the garment by reference to a partially preformed piped opening formed in the other portion of the garment. This is accomplished in the open or expanded position of the garment. The die cut or slit is then formed and the marginal portions reversely folded out of the plane of the garment material to define a formed opening complementing the preformed opening in the other portion of the garment. The respective garment portions are then folded so that the complementary formed opening is disposed opposite the preformed opening in the other portion and the respective garment portions suitably secured together.

The apparatus by which the piped opening may be automatically formed comprises a supporting means defined by a pair of hingedly connected support sections for relative movement with respect to one another. Each section is provided with means for securing in place thereon the garment portion in which the opening is to be formed. A locating means is operatively associated with one support section for locating the position of a preformed opening formed in one portion of the garment material supported on the associated support section. A forming means is operatively associated with the other support section for forming the opening therein to complement the preformed opening in the other portion of the garment material. The locating means and forming means are suitably coupled so that the positioning of the locating means adjacent the preformed opening in one portion of the garment fabric will accurately locate the forming means to insure that in the folded position of the garment material, the complementary opening formed therein will coincide with the preformed opening in the other portion of the garment.

The forming means includes a forming head which when actuated will sequentially cut and form the complementary opening in the garment fabric. Upon completion of the complementary opening, the forming means is pivoted and the hinged sections of the support means are folded to effect the folding of the garment fabric thereon so that the portion containing the formed complementary opening is disposed in contiguous relationship to the portion with the preformed opening. With the garment material folded and the respective openings formed in the respective portions of the material disposed in alignment, the garment portions are suitably secured, and the piped opening thus formed therein being completed by sewing, stitching or otherwise permanently secured.

Other features and advantages will become more readily apparent when considered in view of the drawings and description in which:

FIG. 29 illustrates a plan view of modified die cut for defining a modified shaped opening.

FIG. 30 illustrates a plan view of an opening defined by die cut of FIG. 29.

FIG. 31 illustrates another modified die cut.

FIG. 32 illustrates an opening defined by the die cut of FIG. 31.

FIG. 33 illustrates another modified die cut.

FIG. 34 illustrates a plan view of an opening defined by die cut of FIG. 33.

FIG. 35 illustrates another modified die cut.

FIG. 36 illustrates the shaped opening defined by die cut 35.

FIG. 38 is a schematic diagram of the control circuit for the apparatus of FIG. 14.

FIG. 39 is a detail view of the control valves for the respective piston and cylinder assembly and the means for programming the respective operations thereof.

FIG. 40 is an end view taken along line 40—40 on FIG. 39.

FIG. 41 is a detail construction of a valve spool.

FIG. 42 is a detail construction of another spool valve.

FIG. 43 is a detail construction of another spool valve.

Figure 1:
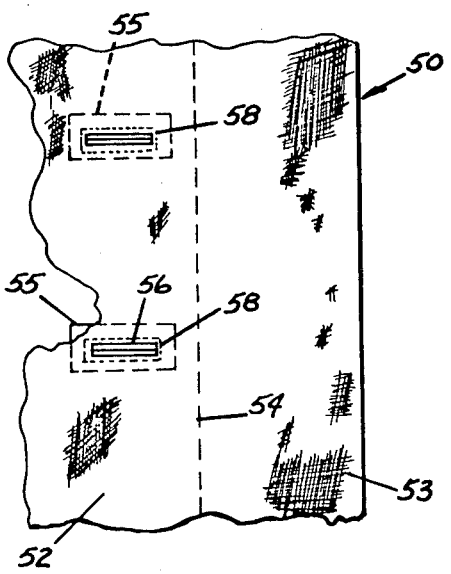
FIG. 1 is a fragmentary portion of a garment wherein the formation of a piped opening to be formed therein is illustrated in the initial stage thereof.

Referring to FIGS. 1 through 5, there is shown a fragmentary portion of a garment or fabric 50 in which a completed piped opening 51 is to be formed, e.g. a buttonhole of a suit, jacket, coat and the like. This portion of the garment is commonly defined as the front portion 52 and an associated facing portion 53 and, which in the finished garment, the facing portion is reversely folded about a fold line 54 to the rear of the front portion in the manner shown in FIGS. 3 and 4. The facing 53 is customarily made of the same fabric as the front portion 52 of the garment 50.

In the construction of piped openings it was heretofore customary to first form an opening 56 in one portion of the garment, e.g. the front portion 52 to which an edging or piping patch 55 is secured. Generally this opening 56 was preformed by suitable known means. However to form the complementary opening 57 in the other portion or facing 53, it was heretofore necessary to fold the material 50 and by feel locate and manually form the die slit or cut and then effect the necessary fold to define the complementary opening.

Figure 2:
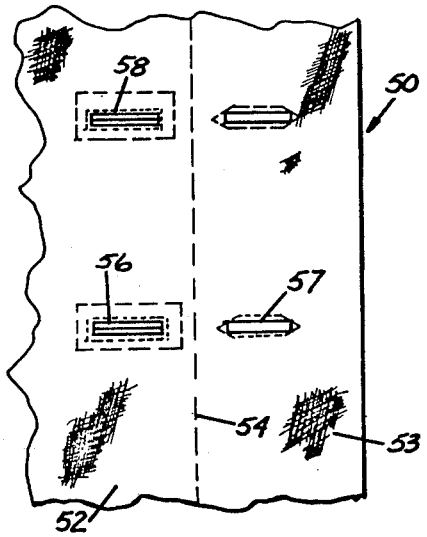
FIG. 2 is a view similar to that of FIG. 1 illustrating a complementary opening formed in the facing portion of the garment.
Figure 3:
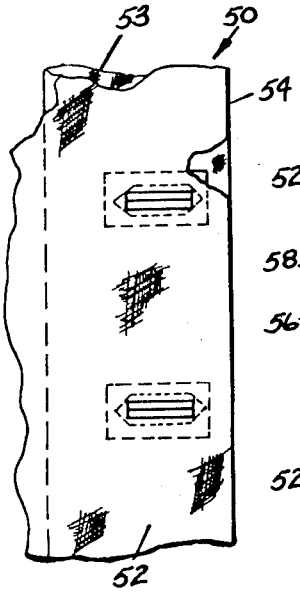
FIG. 3 illustrates a fragmentary portion of the garment as shown in FIGS. 1 and 2 reversely folded along a foldline so that the complementary facing portion in which the opening was formed is opposed the raw opening formed in the front portion of the garment.
Figure 5:
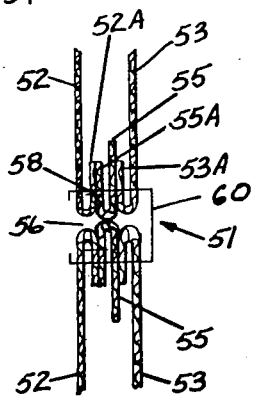
FIG. 5 is an enlarged detailed sectional view taken along line 5—5 on FIG. 4.
Figure 6:
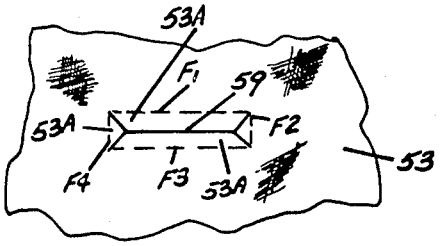
FIG. 6 is an enlarged detail view illustrating the die-cut slit formed in the facing portion of a garment in accordance with this invention.

In the construction of the preformed opening 56 both the front portion 52 and the edging patch 55 have similarly constructed die-cuts or slits formed therein and the respective flaps 52A and 55A defined thereby reversely folded and generally secured by stitching 58 as illustrated in FIG. 5. As noted in FIGS. 1, 2, 3 and 4, the edging patch 55 is secured to the back side of the front portion 52 to define a raw or revealed portion. In the finished garment this raw or unfinished portion is hidden by reversely folding the facing of the garment into overlying relationship with the back side portion of the garment front 52. By this invention the complementary opening 57 opposite the preformed opening 56 in the facing portion of the garment is made in a manner illustrated in FIGS. 6 through 13. With the front and facing portions 52 and 53 of the garment 50 disposed in an expanded position as illustrated in FIGS. 1 and 2, the complementary opening 57 formed in the facing 53 is initiated by forming a slit 59 as shown in FIG. 6. This is attained by locating the cutting means directly opposite the preformed opening 56 in the front portion 52 of the garment as will be hereinafter described so that when the fabric 50 is folded the complementary opening 57 will lie contiguous to the preformed opening 57.

Figure 4:
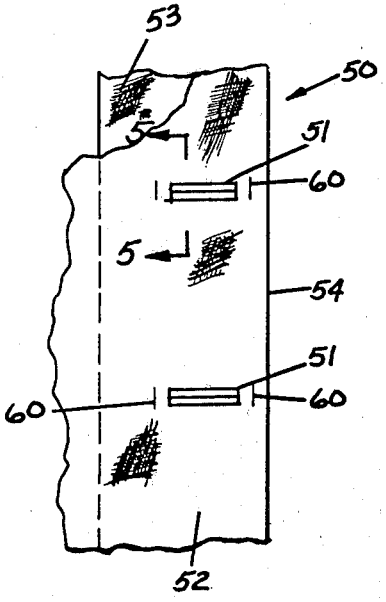
FIG. 4 is a view similar to that of FIG. 3 and illustrating means for securing the reversely folded portion of the garment in the folded position thereof.
Figure 8:
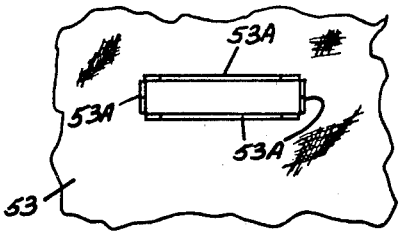
FIG. 8 is a plan view of the facing portion illustrating the marginal or flap portions defined by the slit folded substantially normal to the plane of the garment.
Figure 9:
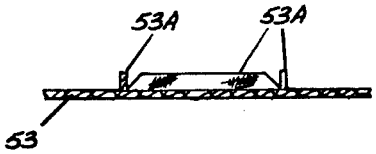
FIG. 9 is an end view of the opening of FIG. 8.
Figure 10:
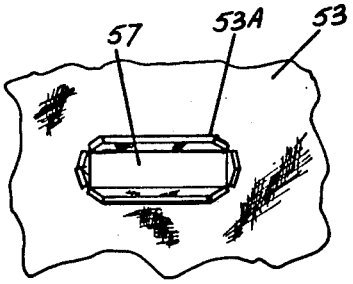
FIG. 10 is a view similar to that of FIG. 8 but illustrating the flap portion reversely folded beyond a plane normal to the plane of the garment.
Figure 12:
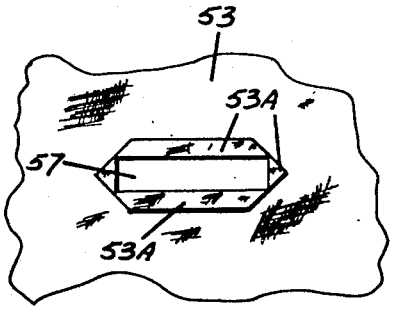
FIG. 12 is a view similar to that of FIG. 10 but illustrating the marginal or flap portions of the opening reversely folded to overlie the plane of the garment to define the formed opening in the facing.
Figure 11:
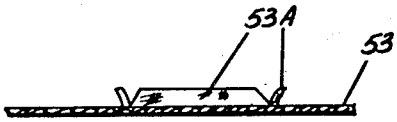
FIG. 11 is an end view of FIG. 10.
Figure 13:
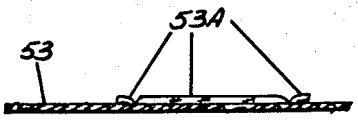
FIG. 13 is an end view of FIG. 12.

As shown therein, it will be noted that the die cut or slit 59 comprises a severed line the end portions of which are formed with short diverging slits as illustrated. To form the complementary opening 57 the marginal portions or flaps 53A of the material circumscribing the die-cut or slit 59 are folded out of the plane of the fabric along fold lines F1, F2, F3, and F4, to a position substantially normal to the plane of the garment portion 53 as illustrated in FIGS. 8 and 9. In this position a substantially rectangular opening 56 is defined thereby. The flaps 53A thus displaced out of the plane of the garment portion 53 are further folded in the direction illustrated in FIGS. 10 and 11, to a position wherein the respective flaps 53A are pressed against the inside surface of the facing portion 53. With the complementary opening so formed in the facing 53 of the garment, the facing is reversely folded along fold line 54 onto the front of the material so that the marginal flaps 53A defining the complementary opening 57 are disposed in contiguous relationship to the patch 55 secured to the back surface of the front portion 52 of the garment 50. Folding the facing 53 onto the front 52 in the manner described, the opening 57 thus formed in the facing 53 is brought in coincident relationship with the preformed opening 56 defined in the front portion 52. The facing and front portions 52, 53 may then be either permanently secured or temporarily secured depending upon the nature of the next desired operation. In FIG. 4 the front and facing portions 52, 53 are temporarily secured, e.g. by means of a staple 60. Alternatively, the garment may be permanently secured as by sewing about the circumference of the completely formed opening therein. In the alternative, the front and facing portions 52, 53 may be permanently secured as by adhesively bonding one to the other. This may be attained by interposing a suitable adhesive between the respective portions 51, 52 or by coating the back surface of the garment with a suitable heat and/or pressure sensitive adhesive.

In the finished opening 51, as illustrated in FIG. 5, it will be noted that by reversely folding a marginal or flap portion defined by the die-cuts or slits, that no raw edges are showing.

As illustrated in FIGS. 1 through 13, the die-cut or slit 59 by which the various openings are initiated is such that a substantially rectangular opening is defined thereby, e.g. opening 56 and 57. However, by varying the shape of the die-cut or slit, the finished opening defined thereby may assume other desirable shapes. Particular reference is made to FIGS. 29, 30, 31, 32, 33, 34, 35 and 36, illustrating differently shaped die-cuts or slits which will define differently shaped openings. FIGS. 29 and 30 illustrate an H-shaped die-cut or slit 60 having the horizontal slit 60A extending between the opposed parallel slits 60B to define an opening 62, when the flaps 61 thereof are reversely folded to a position as indicated in FIG. 30, which is substantially rectangular with pointed ends.

By providing an intersecting die-cut or slit 63 illustrated in FIG. 31, and reversely folding the respective flaps 64 defined thereby, a diamond shape opening 65 as illustrated in FIG. 32 is defined.

FIGS. 33 and 34 illustrate a rectangular die-cut or slit 66 which defines a rectangular opening 67.

FIGS. 35 and 36 illustrate a die-cut or slit 68 for forming shaped opening 69. Die-cut or slit 68 is defined by an elongated single slit 68A having adjacent one end thereof a plurality of radially extending minor slits 68B centered about the end portion of the slit 68A. When the respective flaps 70 defined by respective slits are folded, in a manner illustrated in FIG. 36, a substantially tear-shaped opening 68 is defined thereby. It will become readily apparent that dependent upon the formation of the initial die cut or slit, the size and shape of the opening may be varied accordingly in the finished garment.

Figure 7:
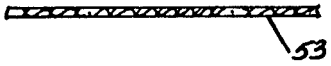
FIG. 7 is an end elevation view of FIG. 6.

The making of the piped openings as herein defined comprises essentially of forming a die-cut or slit of desired configuration in a portion of a garment, e.g. the front portion 52 and reversely folding the flaps 52A defined thereby into overlying relationship onto the back side of the front. An edging flap or patch 55 is similarly die-cut or slit and folded so that the flaps 55A defined are disposed contiguous to the corresponding flaps 52A circumscribing the opening formed on the front 52 and the corresponding flaps 52A and 55A suitably secured together as by stitching 58. A complementary opening 57 is then formed in the facing portion of the garment. This is attained by disposing the front and facing portions 52, 53 of the garment in an expanded position as illustrated in FIGS. 1 and 2, and locating of the position of the die cut or slit to define the opening 57 in the facing of the material directly opposite the formed opening 56 in the front portion by reference to the position of the formed opening 56 formed in the front and/or the fold line 54 about which the facing is reversely folded with respect to the front. A die cut or slit 59 of predetermined configuration is formed in the facing directly opposite the formed opening 57 in the front. With the die cut or slit 59 thus formed, the flaps 53A circumscribing the die cut or slit, as best seen in FIGS. 7 and 8, are folded outwardly of the plane of the facing material to a position substantially normal thereto as in FIGS. 8 and 9. The flaps thus displaced are then reversely folded into contiguous relationship onto the back side of the facing 53. With the opening 57 so formed in the facing, the facing 53 is reversely folded into contiguous relationship to the front 52, so that the reversely folded flaps 53A of the facing 53 are disposed contiguous to the formed opening 56 in the edging patch 55 and the front 52. The facing is then secured in the assembled position thereof to define the completed piped opening 51.

The securing of the facing 53 to the front 52 may be provided by temporary securing means, as for example, by stapling or basting. If desired, the front 52 may be permanently secured to the facing 53 by stitching a seam about the circumference of the opening 51. As an alternative the facing 53 may be adhesively secured to the front 52 of the garment to provide the means for permanently securing the facing to the front.

Figure 14:
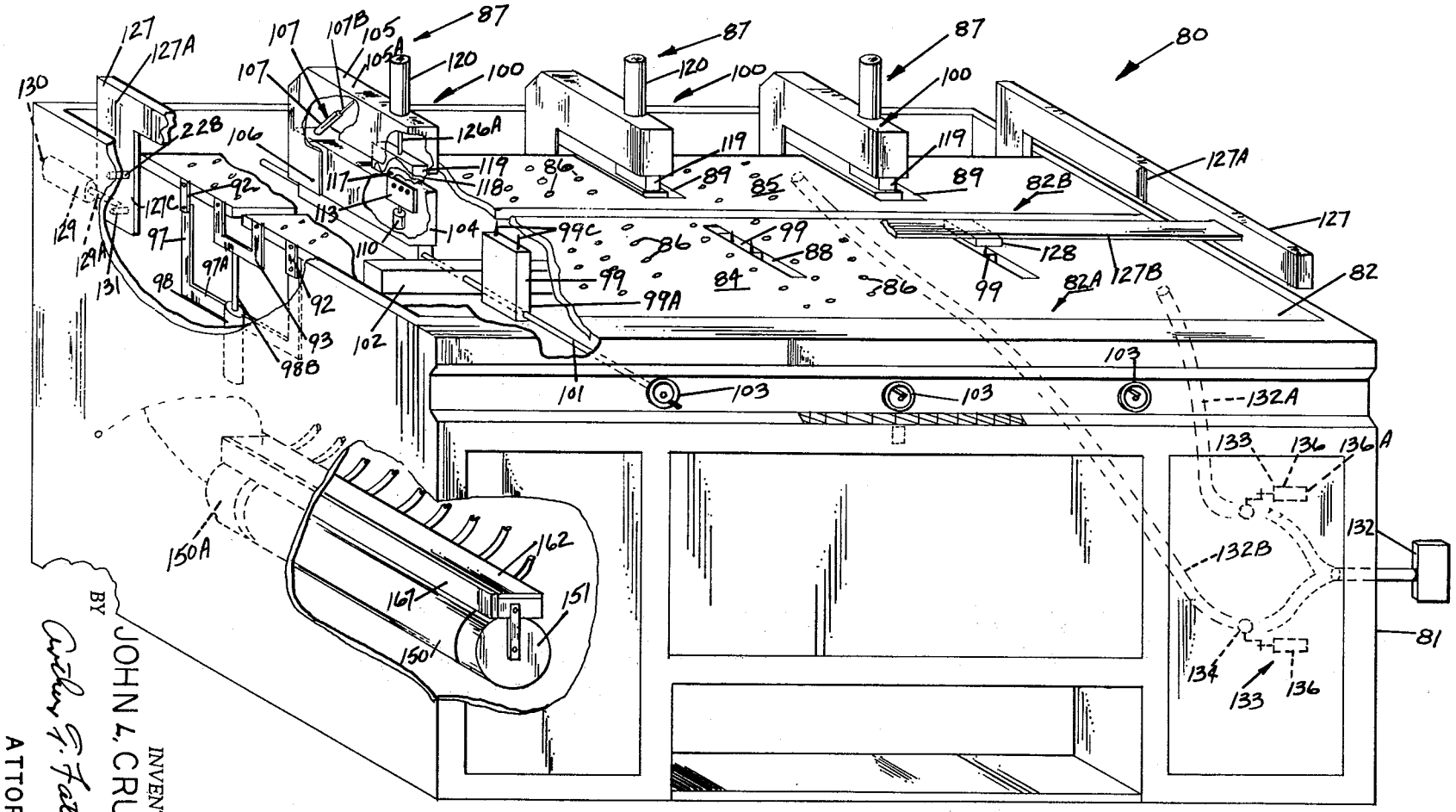
FIG. 14 illustrates a prospective view of an apparatus for locating and forming the complementary opening in the facing portion in accordance with this invention, with portions thereof broken away and/or shown in sections.

Referring to FIG. 14, there is illustrated an embodiment of an apparatus 80 for forming the piped opening 51 in a garment 50. The apparatus 80 comprises a housing 81 defined as a rectangularly disposed frame structure on which there is a support means 82 upon which the garment or fabric 50 is supported in an expanded position as viewed in FIGS. 1 and 2. The support means comprises a first section 82A and a second section 82B which are hingedly connected so that one is rendered movable relative to the other. Each support section 82A, 82B includes a hollow chamber to define a vacuum chamber 83A, 83B. The top 84, 85 of each section is provided with a plurality of apertures or openings 86 which communicate with the subjacent vacuum chamber 83A, 83B.

Figure 16:
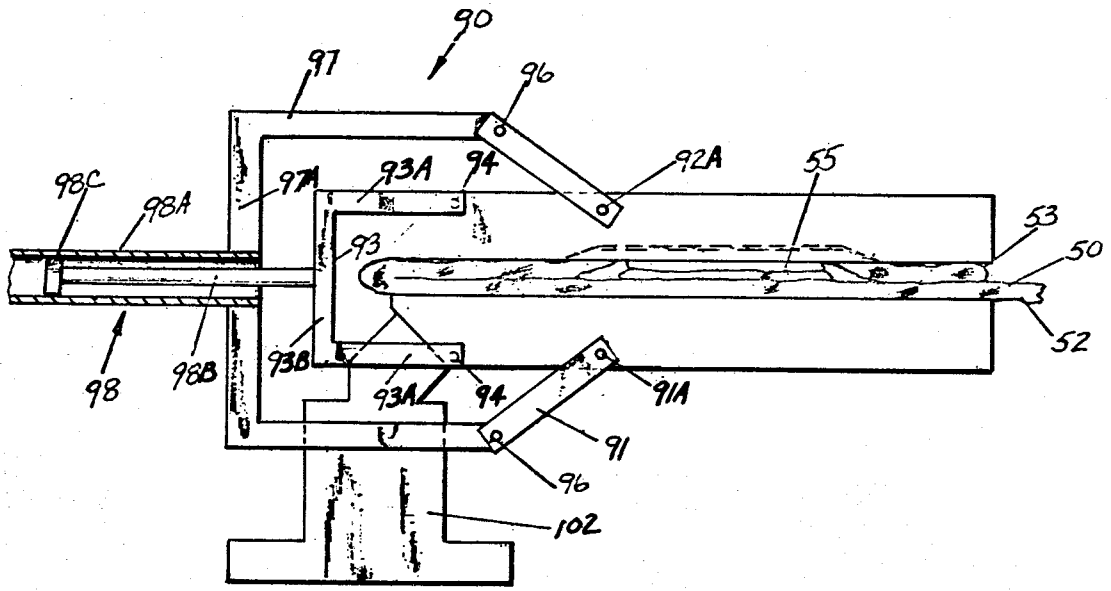
FIG. 16 is a fragmentary portion end view of the apparatus of FIGS. 15 and 15A illustrated in the finally folded position.
Figure 18:
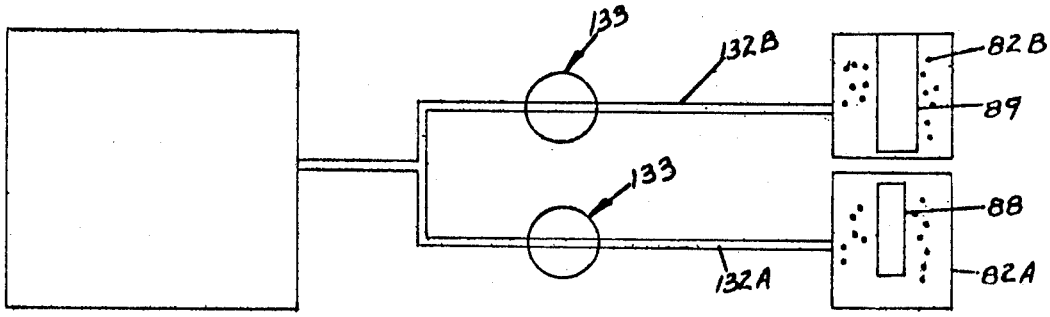
FIG. 18 is a schematic illustration of the controls for actuating the support means of FIGS. 15, 15A and 16.
Figure 17:
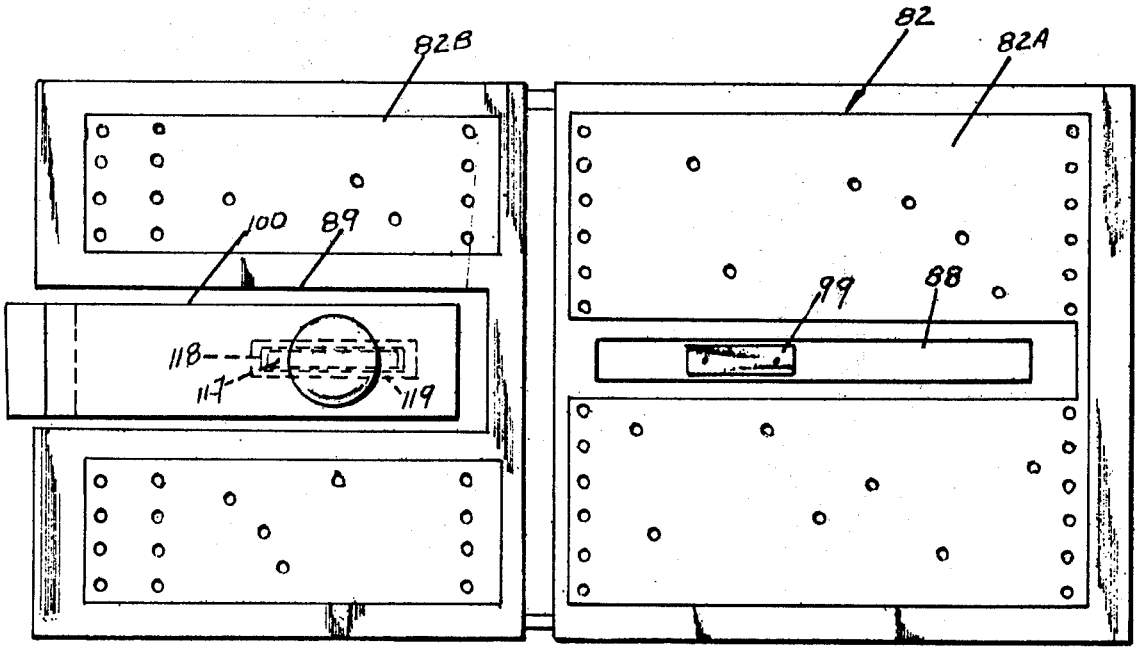
FIG. 17 is a detail plan view of the support means of the apparatus of FIGS. 14 through 16.

A hinge means 90 hingedly connectes support section 82A to support section 82B. Referring to FIGS. 14 and 16 the hinge means comprises a pair of straps 91 and 92, each being pivoted about pin 91A, 92A to the respective support sections 82A, 82B. A U-shaped strap 93 is secured to the respective sections 82A, 82B by having the ends of the respective leg portions thereof 93A secured thereto by pins 94. The other ends of straps 91, 92 are pivotly connected about pins 96 to the end portions of a second U-shaped strap 97.

The actuation of the hinge means 90, to effect movement of the support section 82B relative to support section 82A, is attained by a piston and cylinder assembly 98. The cylinder portion 98A is secured to the cross piece 97A of the strap 97 and the piston rod 98B of piston 98C is secured to the cross piece 93B of strap 93. Thus as viewed in FIGS. 15A and 16, wherever the piston assembly 98 is actuated the support sections 82A, 82B will pivot relative to one another. The hinge means 90 secures the respective sections so as to define a small spacing therebetween.

As noted in FIG. 14 support sections extend the length of the frame to provide for one or more forming stations 87. In the embodiment of FIG. 14 three forming stations are shown; however, it will be understood that the number of stations 87 may vary. Each station is similarly constructed and a description of one station 87 will be sufficient for an understanding of the invention.

Each station 87 is defined by a rectangular opening 88 which extends through support section 82A and an oppositely disposed slotted opening 89 extending through support section 82B.

The forming station also includes a locating means 99 adjustably disposed within opening 88 of section 82A, and a forming means 100 adjustably mounted in the oppositely disposed slotted opening 89 of section 82B. As shown in FIG. 14, the locating means 99 and forming means 100 are adjustably coupled together by a coupling means in the form of a thread shaft 101.

Figure 15:
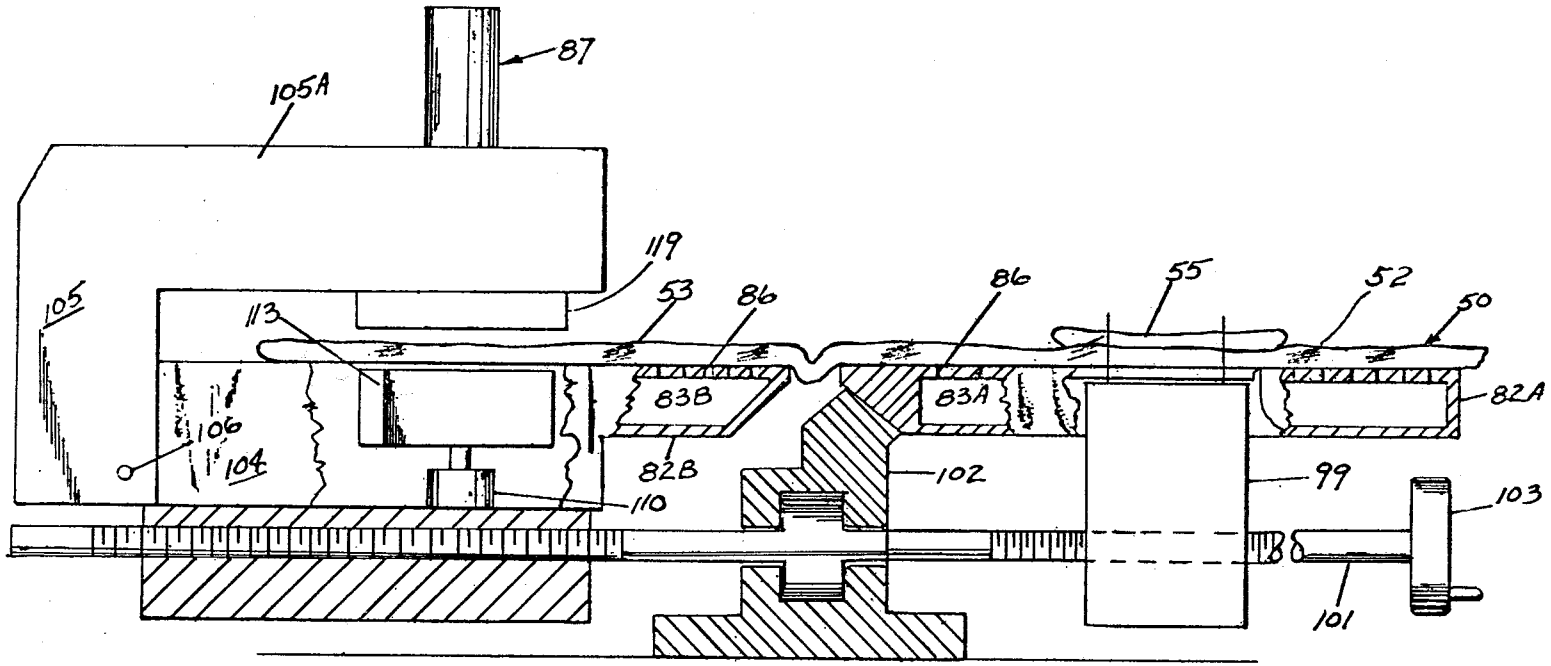
FIG. 15 is an enlarged fragmentary end view of the apparatus of FIG. 14.
Figure 15A:
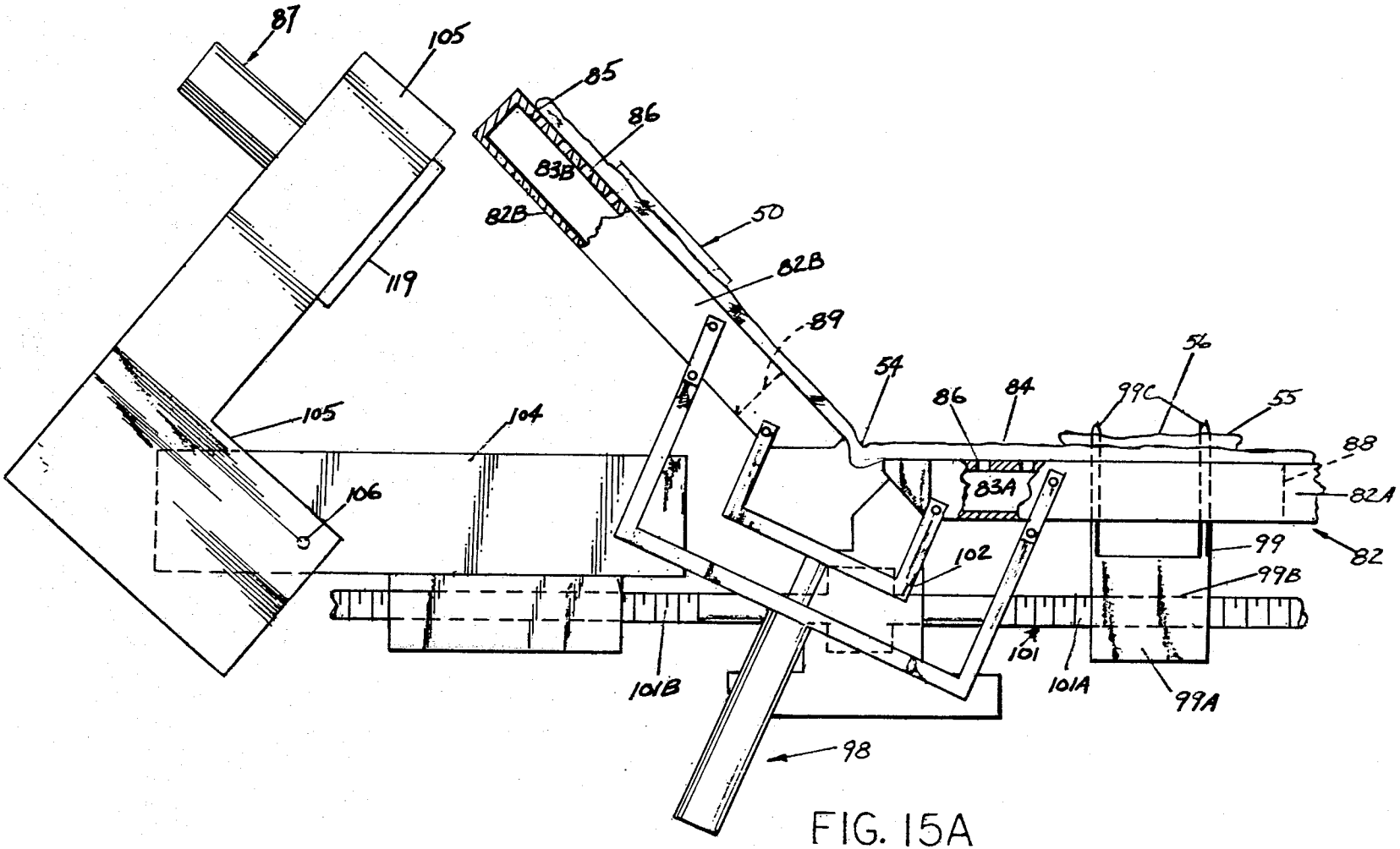
FIG. 15A illustrates a view similar to that of FIG. 15 but illustrating the component parts thereof in an intermediate folded position.

As best seen in FIG. 15A the coupling shaft 101 is rotatably journalled in a suitable bearing 102 adjacent the midpoint thereof. One end of the shaft 101 extends to the front of the apparatus and has connected thereto a turn wheel 103 by which the shaft 101 may be rotated. The shaft 101 is provided with oppositely disposed thread sections 101A and 101B on which the respective location means 99 and forming means 100 are mounted respectively to effect coordinate adjustment thereof.

The locating means 99 includes a base portion 99A having a thread bore 99B extending therethrough for accommodating threaded portion 101A of shaft 101. Carried on the base 99 are a pair of space locating pins 99C which are adapted to extend beyond the top 84 of section 82A. If desired the pins 99C may be adjustably mounted on base 99A to vary the spacing therebetween. The locating pins 99C are adapted to engage the end portion of the partially formed opening 56 in the fabric or garment 50 positioned on the support means 82. Because the position of the preformed opening 56 relative to the fold line 54 may vary from garment to garment, the locating means 99 can be readily adjusted within its opening 88 to accommodate a variety of garments by turning the shaft 101 in one direction or the other.

The forming means 100 includes a base or carrier 104 which has a portion 104A with a threaded bore 104B for receiving the threaded portion 101B of shaft 101. A forming head 105 having an overhanging arm 105A extending over the top 85 of table section 82B is pivotally connected to the carrier or base 104 about pivot 106.

Figure 27:
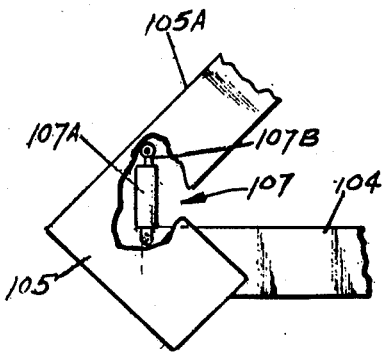
FIG. 27 is a fragmentary detail side elevation view of the forming means illustrated in a pivoted position thereof.

Pivoting of the forming head 105 relative to the base is attained by a piston and cylinder assembly 107. As seen in FIGS. 14 and 27 the cylinder 107A is pivoted at one end to the base 104 and the piston rod 107B of the assembly 107 is pivotally connected to the overhanging arm 105A of the forming head 105.

Figure 25:
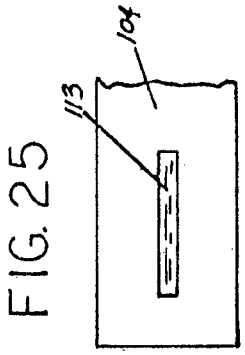
FIG. 25 is a plan view taken along line 25—25 on FIG. 19, rotated 90 degrees.
Figure 19:
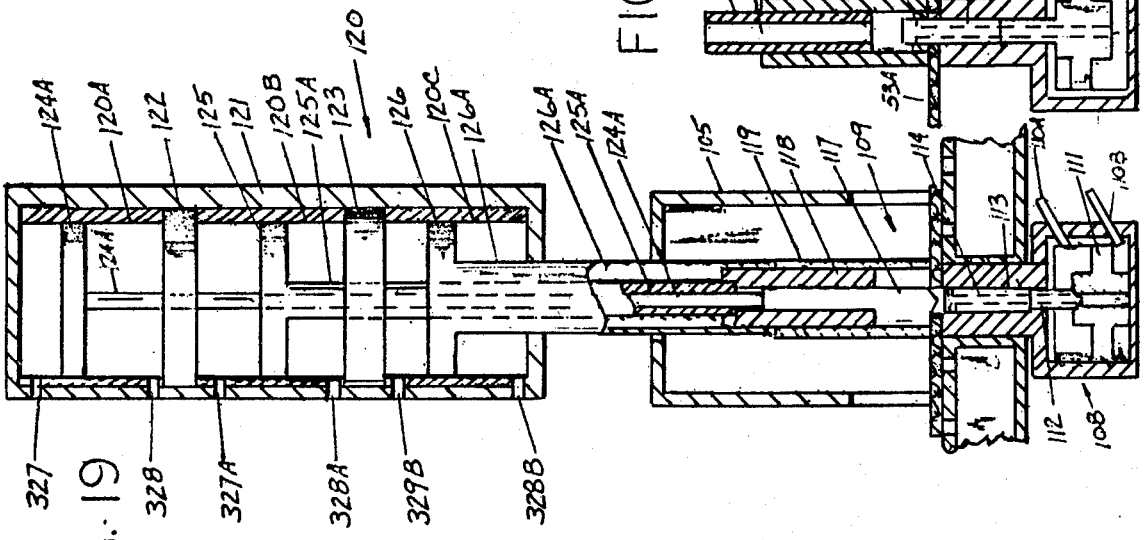
FIG. 19 is an enlarged detail front elevation view of the cutting and forming head of the apparatus of FIG. 14, illustrated in the die cutting position.
Figure 26:
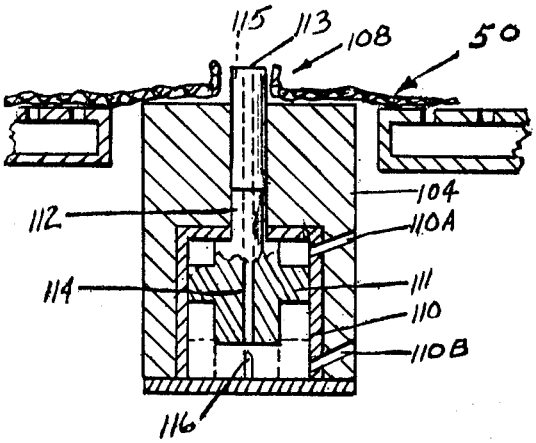
FIG. 26 is an enlarged detailed view of the base portion of a forming means.

The forming means 105 includes complementary means including a presser head and a folding head for forming the complementary opening in the garment or fabric 50. Referring to FIGS. 19 to 25 the forming head or anvil means 108 is disposed in the base or carrier portion 104 of the forming means and a complementary presser head which includes a cutting die means 109 is carried in the head portion 105 of the forming means. In FIGS. 19 and 26 the details of the anvil means or folding head 108 include a cylinder assembly 110 on which there is reciprocally mounted a piston 111 and connected piston rod 112. Connected to the piston rod 112 and adapted to extend beyond the top of the carrier is an anvil or folder 113. As seen in FIG. 25 the anvil or folder is shaped to the opening to be formed in the garment 50. In the illustrated embodiment the anvil 113 is rectangular in shape.

As seen in FIG. 26 the anvil and connected piston rod 112 and piston 111 is provided with a longitudinally extending bore 114 to provide a passageway with communicating port openings 115 opening laterally of the anvil 113. In the base of the cylinder 110 there is provided a needle valve 116 which is adapted to valve the passageway 114. The arrangement is such that the needle valve will prohibit the flow of fluid through passageway 114 and connected port openings 115 in the retracted or lowered position of the anvil 113 and piston 111, but which will permit fluid flow through passageway 114 in the extended position thereof as shown in FIG. 26 as will be hereinafter described. Passageways 110A and 110B connect the cylinder 110 to a source of fluid pressure.

Figure 24:
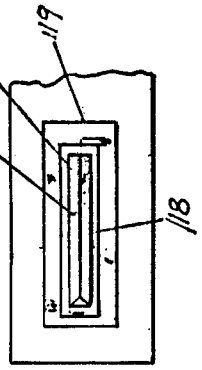
FIG. 24 is an enlarged detail bottom view of the forming means taken along line 24—24 and rotated 90 degrees.
Figure 23:
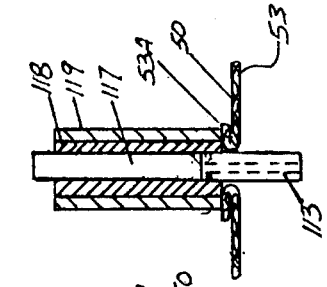
FIG. 23 is a view similar to that of FIG. 22 but illustrating the component parts of the forming means in the final forming position thereof.

The complementary cutting means 109 carried in the head 105 of the forming means includes a comlementary cutting means or die 117 which is reciprocally mounted within the head 105. As seen in FIG. 24 the cutter 117 is provided with a cutting edge 117A which when actuated will form a die cut or slit in the fabric similar to that shown in FIG. 6.

Concentrically disposed with respect to the cutter means 117 is a presser means 118 reciprocally mounted for relative movement with respect to the cutter means 117. Concentrically disposed with respect to both the cutter means 117 and presser means 118 is a guide and hold down means 119 and it is rendered reciprocally mounted relative to the cutter 117 and presser 118.

As will be herein described the cutter means 117, the presser 118, and the hold down means 119 are each individually actuated in a manner to be described for effecting the sequential operations necessary to form the initial die cut or slit and the subsequent folding of the flaps out of the plane of the material 50 to define the complementary opening 57. As seen in FIGS. 19 to 24 the hold down means 119 is shaped to define the outer periphery of the opening 57 to be formed and accordingly it is shaped to complement the shape of the anvil 113.

The means for effecting individual actuation of the cutter means 117, presser means 118, and hold down means 119, is attained by a piston and cylinder assembly 120 located on the overhanging arm 105A of the forming means 100. Referring to FIG. 19 the piston and cylinder assembly 120 includes three axially aligned piston and cylinders 120A, 120B and 120C which are respectively connected to cutter 117, presser 118, and hold down 119. As shown the outer cylinder 121 is provided with a plurality of partitions 122 and 123 to define the outer cylinder into three cylindrical chambers 120A, 120B and 120C. Each cylindrical chamber 120A, 120B and 120C is provided with a piston 124, 125 and 126 and a connected piston rod 124A, 125A and 126A respectively. As shown piston rods 124A, 125A and 126A are concentrically disposed and each has its other end connected respectively to cutter 117, presser 118 and hold down and guide 119. Each cylindrical chamber portion 120A, 120B and 120C is provided with its respective fluid inlet and outlets 327, 328; 327A, 328A; 327B, 328B, disposed on opposite sides of the respective pistons 124, 125 and 126. As will be hereinafter described suitable valves and valve controls are provided to effect sequential operation of the respective cutter 117, presser 118, and hold down means 119 to effect individual operation thereof to form the complementary opening 57 in the fabric or garment 50.

A support bracket 127 is pivotally mounted to the frame 81 about opposed pivots 228 (FIG. 14). As shown opposed brackets 127 are each provided with forwardly extending arm portions 127A which overhang support section 82. Interconnected between arms 127A is a cross piece 127B on which there is supported a securing means 128. The securing means 128, as hereinafter described is to secure the garment in the folded position thereof to secure the finished opening. The securing means 128 may be either a stapling means or a sewing means for either temporarily or permanently securing the front onto the facing in the folded position of the garment or fabric 50.

The support brackets are actuated between a raised and lowered position by a piston and cylinder assembly 129. The piston and cylinder assembly 129 is secured between mounting 130 and 131, the rod 129A of the piston being connected to the depending leg 127C of brackets 127. Accordingly the support brackets and connected cross arm 127B are pivoted between a raised and lowered position as the piston and cylinder assembly 129 is actuated.

Figure 28:
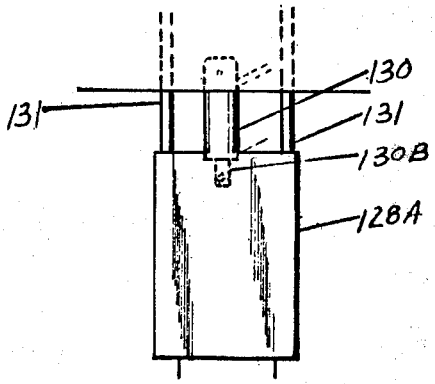
FIG. 28 is an illustration of the securing means adapted to temporarily secure the garment in the folded position thereof as shown in FIG. 4.

The securing means 128 in the illustrated form of the invention, as in FIG. 28, is raised and lowered between operative and inoperative piston by a piston and cylinder assembly 130. The body 128A of the securing means is suspended from the cross piece 127B of brackets 127 by guide rods 131. The cylinder 130A of assembly 130 is fixed to the bracket support and the piston rod 130B fixed to the body of the securing means 128. Thus when the piston and cylinder assembly is actuated the securing means is lowered to effect the securing of the fabric in the folded position. The securing means 128 is illustrated as a stapling device, however, it will be understood that other types of securing means may be substituted therefor depending upon the type of securing desired. For example, the securing means may take the form of a sewing machine which would effect a sewing operation to secure the front to the facing of the garment or to sew the formed piped opening. The securing means may also take the form of a heater and press in the event it was desired to effect securing by fusion and/or by heat and pressure as in the case of plastic garments.

In accordance with this invention the vacuum chamber 82A and 83B of support sections 82A, 82B are each connected to a source of negative pressure, e.g. a vacuum pump 132. (FIG. 14). As shown the vacuum pump 132 is connected to each chamber 83A, 83B by suitable conduits 132A, 132B through which the flow of negative pressure is controlled by suitable shut-off means 133 schematically illustrated in FIG. 14.

Figure 37:
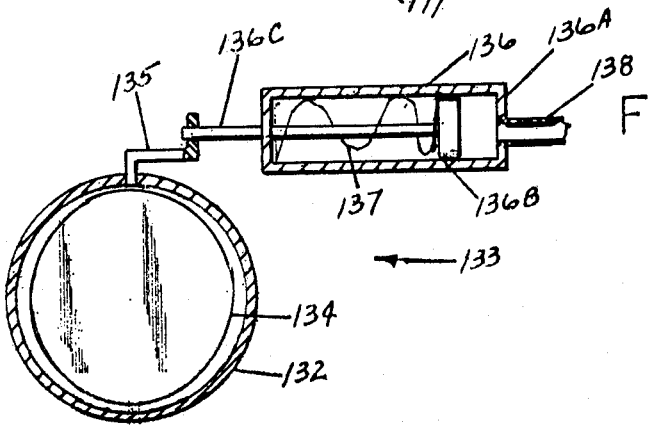
FIG. 37 illustrates the details of the shut off means for controlling the vacuum pressure on the support sections.

Referring to FIG. 37 the shut off means 133 in the respective lines 132A, 132B includes a butterfly damper or shut off valve 134 pivotally mounted within each line 132A, 132B. An actuating arm 135 is connected to the damper or valve 134 to effect rotation thereof between open or closed positions or an intermediate position to control the fluid pressure in the lines 132A, 132B. The means for setting the respective valves 134 includes a single acting piston assembly 136. As shown in FIG. 37 the cylinder 136A has a piston 136B and connected piston rod 136C reciprocally mounted therein.

The end of the rod 136C is operatively connected to the actuating arm 135 of valve 134. Fluid pressure for actuating the piston 136 is introduced through port 138. A spring 137 is disposed about the piston rod 136C within the cylinder 136A to normally resist the pressure of the fluid acting on the piston 136B and to return the piston and connected rod to its normal position. By controlling the position of the butterfly valve 134 in the respective lines 132A, 132B, the amount of vacuum pressure in each support section can be controlled thereby.

The respective component parts of the apparatus actuated by the various piston and cylinder assemblies are controlled by suitable valves to control the flow of actuating fluid thereto, and a programming means for effecting sequential actuation of the respective valves in a predetermined sequence to effect automatic actuation of the functional parts of the apparatus.

Referring to FIG. 38, the control system consists of eight two-way cylinder assemblies, three of which are concentrically arranged to effect actuation of the die cutter 117, the presser 118, and the hold down guide 119. These two-way cylinders are 120A, 120B and 120C. The other two-way cylinders are cylinder 110 controlling the anvil 113, cylinder 130 controlling the actuation of the securing means 128, cylinder 107 actuating the pivoting of the forming head 105, the cylinder 98 actuating the folding of the table supports 82B, and cylinder 129 for pivoting the bracket supports 127 for locating the positioning of the securing means. Actuation of cylinders 110, 130, 120A, 120B, 120C, 107, 98 and 129 are effected by a four-way valve 140, 141, 142, 143, 144, 145, 146 and 147 respectively each having a spool valve of the type shown in FIG. 42.

Figure 46:
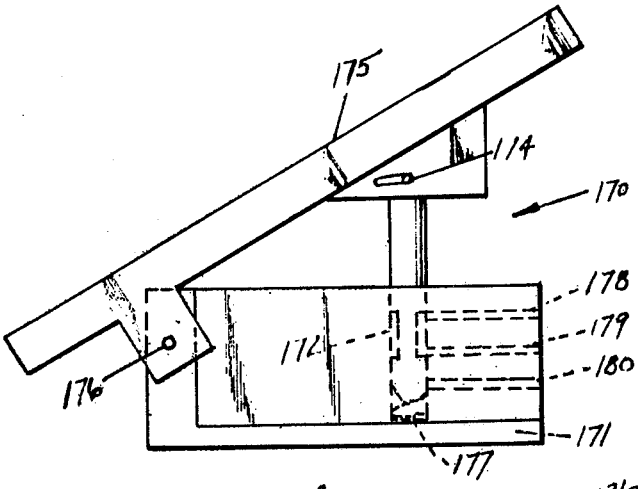
FIG. 46 is a detail view of a foot switch.

The single acting cylinders 136 and 136A for controlling the vacuum pressure to the vacuum chambers 83A, 83B of support sections are controlled by three-way valves 148 and 149. Valve 149 is located at a convenient place so as to be readily available to an operator, and it may comprise a foot pedal switch as shown in FIG. 46. Actuation of this valve 149 controls the holding of the material to the support means 82 as will be herein described. Valve 148 serves to actuate cylinder 136A to release the vacuum acting on support section 82B to release the fabric supported thereon.

Figure 45:
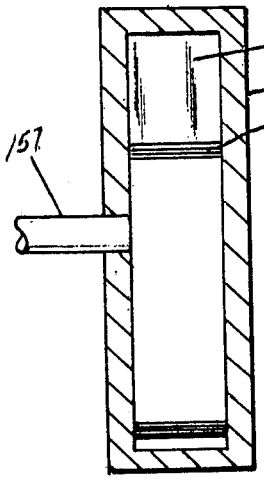
FIG. 45 is an end view of the air motor.
Figure 44:
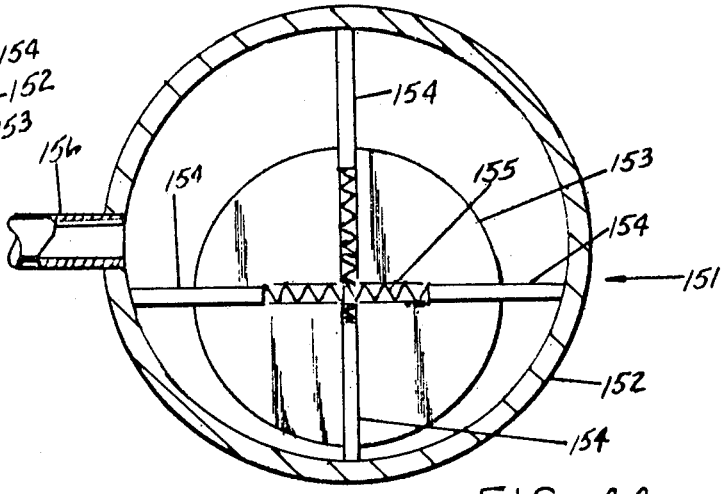
FIG. 44 is a detail view of an air motor.

Each of valves 140 to 148 are actuated in a predetermined sequence or order by a programming drum 150. The programming drum 150 is actuated by a suitable drive means. In the illustrated form of the invention the drive means comprises an air motor 151 of a type illustrated in FIGS. 44 and 45. The air motor comprises essentially of a housing 152 in which there is rotatably journalled an eccentric 153 having a plurality of movable vanes 154 mounted thereon. The vanes 154 are biased toward the circumference of the housing by springs 155. Inlet 156 defines the fluid inlet to the air motor 151. The output shaft 157 of the motor is coupled to the shaft 158 of the programmer drum 150.

The air motor 151 in turn is controlled by valve 159 which functions as a fluid metering valve capable of an on-off position. Accordingly valve 159 is capable of stopping fluid flow and the motor 151. Valve 159 is programmed by an auxiliary programmer 150A which is detachably connected to the drum 150. Thus by interchange of auxiliary programmer section 150A, the speed of the fluid motor can be varied accordingly.

A valve 160 is interposed in the fluid line to the motor 151 to also effect the starting and stopping of the apparatus. Valve 160 in effect constitutes the start switch and it is conveniently located, e.g. as on the front of the apparatus, and it functions to override the metering valve 159.

The programming drum 150 is operatively conneted to a manifold block 161. The manifold block is formed with a plurality of valving chambers 140A to 148A and 159A disposed in alignment on which the valve spools 140 to 148 and 159 are located. Each of the valve chambers 140 to 148 and 159 open to a fluid pressure manifold chamber 162 which is connected by conduit 163 to a source of live fluid pressure, e.g. an air compressor. Thus the fluid pressure acting on the manifold will function to urge the respective valve spools 140 to 148 and 159 to bias toward the periphery of the programming drum 150. Accordingly the programming drum is provided with a plurality of cam grooves 140B to 148 B and 159B for receiving the bottom of the respective valve spools. Thereby depending upon the configuration of the respective cam grooves 140B to 148B and 159B, the respective spools will valve ports A,B or C respectively.

In valves 140 to 147 the fluid pressure is supplied at the top of each spool and will flow through either port A or C depending on the position of the spool within its respective valving chamber and thereby be directed to one side or the other of associated cylinder controlled thereby. Port B functions as the exhaust port and port B will exhaust either side of the associated cylinder depending on the position of the valve spool. As shown in FIG. 42 the valve spool adapted to be disposed in each of the four-way valves 140 to 147 comprises valve member 164 having spaced sealing flanges 164A, 164B and a central bore 165 opening to the top and to a lateral port 166. The bottom portion 167 of the valve member defines a side seal with the bottom edge formed as a cam follower to ride the appropriate cam groove of the programming drum 150.

In the up position of the valve member 164 in its respective chamber as noted in chamber 140A of FIG. 39, the flow of fluid from the inlet manifold 162 will be through bore 165 and out port 166 disposed in communication with port C. Port A in turn is connected in communication with port B or exhaust. As seen in FIG. 40 ports B communicate with a common exhaust manifold 167.

When the valve spool member 164 of the four-way valves is in a down position as seen for example only in valve chamber 141A the flow of fluid pressure from the inlet manifold 162 will be out port A to operate on one side of its associated cylinder and the other side of the associated cylinder is being exhausted through port C to port B. It will thus be apparent that by properly shaping the respective cam grooves of the programming drum that the respective spools are actuated to control the operation of their respective operating cylinders in a predetermined sequence.

Valve 159 does not have an A port. In the illustrated embodiment port B of valve 159 is to exhaust and port C connects to the exhaust side of the fluid motor. Valve 159 thus functions to control the exhaust from the fluid motor 151. In this manner the speed and/or operation of the fluid motor can be controlled by the appropriate shaping of the cam groove 159B.

FIG. 46 illustrates a typical foot switch for effecting the vacuum control on support section 82A. The foot valve 170 includes a base 171 having a valve chamber 172 in which a valve spool 173 is movably mounted. The upper end of the spool is connected by a pin and slot connection 174 to the foot pedal 175 hinged to base 171 about pin 176. A spring 177 normally biases the spool. The base is provided with ports 178, 179, and 180 communicating to exhaust, vacuum and pressure respectively. This valve or foot control serves to control the clamping and holding characteristics of the vacuum holding support section 82A, and valve 160 functions as a bypass for metering valve 159.

With the apparatus thus described its operation is as follows.

With the support sections 82A, 82B co-planarly disposed and with the apparatus in the non-operating position a garment 50 on which an opening is to be formed is disposed on the support means 82 with the partially preformed opening in the garment disposed with its raw side thereof facing upwardly on the support section 82A. The facing portion of the garment 53 is disposed on the other section 82B. The arrangement is such that the fold line 54 of the garment will fall in the spacing between sections 82A, 82B. With the garment in position the valves 148 and 149 controlling the vacuum pressure on the respective support sections are energized to subject the material thereon to a holding pressure. The vacuum also functions to smooth out the wrinkle therein and flattens out the material.

With the material thus positioned on the support means, the turn wheel 103 of the coupling shaft is rotated to position the locating means 99 at the position of the preformed opening in the garment 50. Because of the complementary screw portions 101A and 101B it will be noted that the forming head 105A will be located over the facing at a point corresponding to the distance of the locating means from the center line or fold 54 of the garment.

With the positioning of the forming head 105 over the facing of the fabric the starting switch or valve 160 is actuated. This switch or valve will direct fluid pressure to the drive or motor. In doing so the programming drum 150 is actuated.

Accordingly the valve 142 and 144 controlling the operations of the cutter means 117 and the hold down means 119 are actuated to cause the associated pistons 120A and 120C to lower the hold down and cutter to the fabric 50. The timing is such that the hold down means precedes the cutter 117 slightly to hold the material 50 in place as the cutter descends. The piston assembly controlling the anvil 113 is bottomed in its respective cylinder so that the top of the anvil is flush with the top of the support means 82B to form a backing for the cutter.

The descent of the cutter 117 thus causes the appropriate die-cut or slit to be formed in the facing. Upon the forming of the die-cut or slit the cutter is retracted by reversing the fluid flow to the associated operating cylinder 120A. During the retraction of the cutter 117 the hold down means is retained in place against the material. See FIG. 20. At this point the cylinder operating on the anvil is activated to advance the anvil above the top of the support means 82A. In doing so the associated piston is moved upwardly and the anvil connected thereto causes displacement of the flaps 53A upwardly out of the plane of the fabric; the hold down means 119 still in the holding position defining the shape of the opening.

With the flaps disposed the hold down means is retracted by the valve controlling the fluid pressure operating on cylinder 120C reversing the fluid flow thereto.

Figure 22:
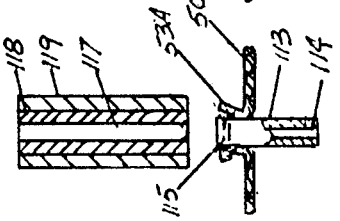
FIG. 22 is a view similar to that of FIG. 21 but illustrating the forming means of still another intermediate position.
Figure 21:
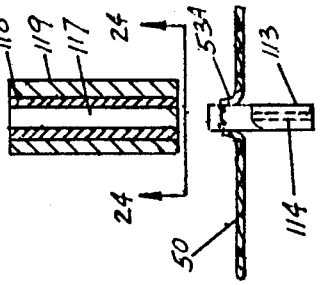
FIG. 21 is a view similar to that of FIG. 20 but illustrating the component parts of the forming means in another intermediate position.
Figure 20:
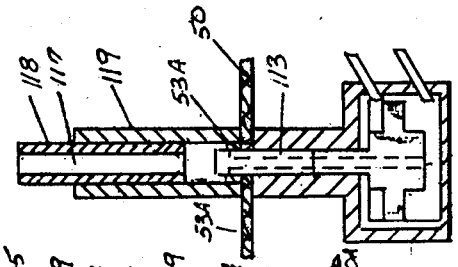
FIG. 20 is a fragmentary front elevation view of the forming head illustrated in an intermediate operating position thereof.

Upon the removal of the hold down means 119 to a position shown in FIG. 21, the flaps 53A are free to be displaced beyond the normal by jets of fluid pressure emanating from ports 115 in the anvil. See FIG. 22. Referring to FIG. 26, it will be noted that the bore 114 in piston 111 is opened in the raised or elevated portion. With the flaps displaced beyond the normal as shown in FIG. 22, the pressure means 118 and the hold down means 119 are lowered to effect the reverse fold of the flaps 53A onto the facing 53. See FIG. 23. In this operation the formation of the complementary opening 57 is formed.

To effect the folding of the fabric so that the facing with the formed opening therein is superposed onto the front, the cylinder 107 and 129 operating on the forming head 105 and the bracket supports are energized by actuation of their appropriate valve means 145 and 147 respectively to effect the pivoting of the head and support bracket to their respective up position. With the forming head 105 and support brackets pivoted out of the way the cylinder 98 actuating the hinge means 90 is actuated to effect the folding of support section 82B onto 82A. In doing so the fabric 50 is folded with the facing 53 and the complementary opening formed therein overlying the front and the preformed opening therein. See FIGS. 15A and 16. With the support sections so folded as in FIG. 16, the vacuum in section 82B is released thereby permitting the section 82B to be returned to its normal co-planar position with respect to section 82A; the facing carried thereby remaining in overlying relationship to the front 52 lying on support section 82A. In this operation the formed opening in the facing is disposed opposite the preformed opening in the facing.

With the folded garment in position on support means 82A and section 82B returned to its co-planar position the cylinder operating on the support brackets is activated by its appropriate valve means 147 to reposition the bracket support and securing means carried thereby. When the securing means has been located over the folded fabric or garment 50, the cylinder 130 controlling the securing means is actuated by valve 141 to secure the facing to the front. In the illustrated embodiment the securing means comprises a stapler which will temporarily staple the facing to the front adjacent the opening therein.

The vacuum on the support 82A is then released and the garment with the opening so formed is removed from the apparatus, after which the apparatus is readied to repeat the cycle of operation.

It will be understood that the securing means may comprise a sewing machine instead of a stapler or may comprise any other type of means for securing the facing to the front.

While the control circuit has been described as a fluid controlled circuit, it will be understood that the control fluid may be either air, gas or liquid. Also the control of the respective operating sequences may be electrically activated wherein solenoids and electric motors may be used instead of piston and cylinder assemblies.

While the present invention has been described with respect to a particular embodiment thereof, it will be understood that variations and modifications may be made without departing from the spirit or scope of the invention.

What is claimed is:

1. An apparatus for locating and forming an opening in the facing of a piece of material adapted to overlie an opening formed in the front of said material to form a finished opening comprising:

means defining a support for the front and facing portions of said material, means for locating the position of the opening to be formed in said facing with respect to a fold line between said facing and front portions, forming means for forming the opening in the facing material to correspond with the opening in said front portion, and actuating means operatively coupling said locating means with said forming means whereby the positioning of the locating means with respect to the opening in said front portion effects the location of the forming means over said facing with respect to said fold line a corresponding amount.

2. The invention as defined in claim 1 wherein said support means comprises:

a first support section adapted to support the facing of said piece of material, and a second support section adapted to support the front of said piece of material, and means for hingedly connecting said first support section to said second support section whereby one section can fold relative to the other section.

3. The invention as defined in claim 1 and including means for holding said piece of material onto said support means to prohibit relative movement therebetween during the locating and forming of the opening therein.

4. The invention as defined in claim 3 wherein said support means defines a vacuum chamber, and said support means having a surface portion formed with a plurality of apertures connected in communication with said vacuum chamber, and means for subjecting said vacuum chamber to a negative pressure to hold said piece of material in position thereon.

5. The invention as defined in claim 1 wherein said forming means comprises a head having an anvil means and a complementary cutting means, said anvil means being adapted to be disposed on one side of said facing material and said cutting means being disposed on the other side of said material, and means for effecting relative movement of said cutter means and anvil means relative to each other to form a die cut in said facing disposed therebetween.

6. The invention as defined in claim 1 wherein said forming means comprises a head having means for sequentially cutting and reversely folding the marginal portions of said die cut to define an opening in the facing of said material to correspond with the opening in said front.

7. The invention as defined in claim 1 wherein said forming head comprises a mount, a cutting means reciprocally mounted for movement relative to said mount, a material hold down means concentrically disposed relative said cutting means and reciprocally mounted for movement relative to said cutter means, a presser means concentrically disposed with respect to said cutter means and material hold down means, and means for effecting relative reciprocation of said cutter means, hold down means and pressure means respectively.

8. The invention as defined in claim 7 and said forming head including an anvil means disposed opposite said cutting means whereby an anvil means is disposed on one side of said material and said cutter means being disposed on the other side of said material.

9. The invention as defined in claim 8 and including means for effecting movement of said anvil means relative to said piece of material.

10. The invention as defined in claim 9 wherein said anvil means includes means defining a passageway therein, means defining a port opening formed in the side of said anvil means, said port opening being disposed in communication with said passageway, and means for supplying a fluid pressure to said passageway.

11. The invention as defined in claim 7 wherein said latter means includes a piston and cylinder assembly operatively connected to said cutter means, hold down means and presser means respectively.

12. The invention as defined in claim 11 wherein the respective piston and cylinder assemblies of the respective cutter means, hold down means and presser means are disposed in co-axial alignment.

13. The invention as defined in claim 2 and including means for securing said facing to said front in the folded position of said piece of material.

14. The invention as defined in claim 13 wherein said securing means comprises a stapling means.

15. The invention as defined in claim 10 and including means for valving said passageway in said anvil means to prohibit the flow of fluid therethrough in the inoperative position thereof.

16. An apparatus for forming an opening in a piece of material comprising a supporting means including a first section and a second section hingedly connected thereto, whereby said section may be folded to overlying position, means for holding a piece of material in place on said support means whereby a portion of said material is supported on said first section and a portion supported on said second section, locating means operatively associated with said first section for locating an opening formed in the material supported thereon, a forming means operatively associated with said second section, means coupling said locating means with said forming means whereby said locating means and forming means can be moved relative to one another corresponding amounts with respect to the material supported on the respective section of said support means, said forming means including a head portion and a base portion, said head portion and base portion being disposed on opposite sides of the material on said support means, a cutting means disposed in said head portion and an anvil means disposed in said base portion, and means for effecting relative movement of said cutter means relative to said anvil means for die cutting a slit in the material disposed therebetween on said support means.

17. The invention as defined in claim 16 including means pivotally connecting the head portion of said forming means to said base portion for pivoting said head between an operative and inoperative position.

18. The invention as defined in claim 17 and including means for folding the respective portions of the material, and means for securing the respective portions of the material in the folded position thereof.

19. The invention as defined in claim 17 wherein said coupling means includes a threaded shaft having oppositely disposed thread portions thereon, said locating means of said forming means being threaded to the respective thread portions of said shaft, and the respective threaded portions of said shaft being pitched so that rotation of said shaft effects predetermined relative corresponding displacement of said locating means and forming means.

20. The invention as defined in claim 16 wherein the head portion of said forming means includes a presser means movably mounted therein, said presser means being co-axially disposed relative to said cutter means and rendered movable relative thereto.

21. The invention as defined in claim 20 wherein said head portion of said forming means includes a hold down means mounted therein, said hold down means being co-axially disposed with respect to said presser means and cutter means, and rendered movable relative thereto.

22. The invention as defined in claim 21 and including means for rendering said cutter means, presser means and hold down means individually movable.

23. The invention as defined in claim 22 wherein said latter means includes a piston and cylinder assembly for actuating the respective cutter means, presser means and hold down means, the respective piston and cylinder means being co-axially disposed.

* * * * *